United States Patent [19]

Touzalin et al.

[11] Patent Number: 5,054,220

[45] Date of Patent: Oct. 8, 1991

[54] PRODUCT IDENTIFICATION SYSTEM

[75] Inventors: Richard J. Touzalin, Richmond Hill; Brian J. Zettler, Scarborough, both of Canada

[73] Assignee: Warner-Lambert Company, Morris Plains, N.J.

[21] Appl. No.: 523,085

[22] Filed: May 14, 1990

Related U.S. Application Data

[63] Continuation of Ser. No. 279,390, Dec. 2, 1988, abandoned.

[30] Foreign Application Priority Data

Nov. 25, 1988 [CA] Canada ..... 584182

[51] Int. Cl.[5] ..... G09F 3/18

[52] U.S. Cl. ..... 40/642; 40/658

[58] Field of Search ..... 40/642, 658, 618, 620, 40/325, 617, 649, 606, 611, 658, 659; 248/222.1, 222.3, 220.3, 220.4, 218.4; 211/110, 170, 59.1, 89

[56] References Cited

U.S. PATENT DOCUMENTS

| | | | |
|---|---|---|---|
| 734,212 | 7/1903 | Ayres et al. | 40/618 |
| 1,560,092 | 11/1925 | Odquist | 40/325 |
| 1,942,240 | 1/1934 | Chernow | 40/618 |
| 2,880,533 | 4/1959 | Troendly | 40/617 |
| 3,324,585 | 6/1967 | Frederickson | 40/658 |
| 3,714,724 | 2/1973 | Slavsky | 40/658 |
| 3,797,143 | 3/1974 | Miller | 40/658 |
| 3,817,394 | 6/1974 | Saiki | 248/218.4 |
| 4,500,880 | 2/1985 | Gomersall et al. | 40/5 |
| 4,540,093 | 9/1985 | Merl et al. | 40/649 |

FOREIGN PATENT DOCUMENTS

| | | | |
|---|---|---|---|
| 260743 | 3/1968 | Austria | 40/642 |
| 1175493 | 3/1959 | France | 40/618 |
| 178904 | 4/1962 | Sweden | 40/618 |
| 2117156 | 10/1983 | United Kingdom | 40/606 |
| 2205189 | 11/1988 | United Kingdom | 40/611 |
| 8100162 | 1/1981 | World Int. Prop. O. | 40/618 |

*Primary Examiner*—Kenneth J. Dorner
*Assistant Examiner*—J. Hakomaki
*Attorney, Agent, or Firm*—Charles A. Gaglia, Jr.

[57] ABSTRACT

A structure for supporting a product label in connection with a product rack comprised of tubular support members. The present invention provides a planar face which is configured to fit between and among the tubular members which form the rack. This generally rectangular face is used as a backing for labels, such as product labels. The present invention also discloses side walls which extend generally downwardly over a generally concave curve from the rectangular face. The curve of the generally downwardly extending side walls is such that it can snappingly engage the tubular members of the rack. In certain rectangular, square and other similar configurations of the planar face, additional downwardly extending side walls may also be included within the structure. These side walls may or may not engage the tubular members of the rack. A lip structure extending generally perpendicularly outwardly from the lower edges of the side walls is also provided. The perpendicularly extending lip structure helps to securely hold the device between the tubular members of the rack. Finally, a label may be placed on the planar face. The label is of such a size as to overlap the face and engage a portion of the tubular members. Thus, the device is held securely in place by the combination of the label, the lip structure, and the engaging side walls. The device is also easily removable and replaced so as to provide great flexibility to those having use for labeled shelves.

8 Claims, 3 Drawing Sheets

PRODUCT IDENTIFICATION SYSTEM

This is a continuation of copending application Ser. No. 07/279,390 filed on Dec. 2, 1988, now abandoned.

BACKGROUND

1. Field of the Invention

The present invention relates generally to a system for supporting a product identification label. More particularly, the present invention relates to a structure capable of removable attachment to a portion of a product rack and also capable of supporting a product identification label.

2. Background of the Invention

It is an age old problem in merchandising to find appropriate ways for labeling products. It is also a problem to find appropriate and convenient ways in which to place labels on product racks and holders. This is particularly true in modern supermarkets. Modern supermarkets require that product racks and identification labels be easily interchangeable so that product displays within the store can be flexible and moveable as necessary. This allows the store operator to maximize the efficiency of the store and to provide for changes in the store format. For example, it may be necessary for the store manager to introduce new products and to phase out old products. In addition, flexible product displays allow the store manager to experiment with different product alignments in order to obtain the most effective and efficient setup for his customers. Thus, it is important that product shelving and labels be flexible in their application.

One persistent problem has been in finding appropriate ways in which to attach product labels to either permanent or removable racks. As mentioned above, it is desirable that display labels be readily interchangeable from place to place on the merchandise containing shelf. Likewise, it is desirable that racks and labels have a pleasing appearance and a finished surface in order to present a good impression to the customer and also to avoid any accidents that may be caused by consumer interaction with the particular rack and label. That is, rough or sharp edges, and the like, should be eliminated in order to avoid cutting and scratching a person's hand when they reach for a product.

Many types of retail stores make extensive use of wire racks or tubular support mechanisms for various types of products. For example, tubular or wire racks are often used to support small items, such as chewing gum, candy products, and other small convenience items. Wire racks and tubular supports are also used at various times to support other items, such as canned goods and paper products.

One of the difficult problems in store management has been finding an appropriate mechanism for attaching product labels to these types of wire or tubular racks. For some purposes, it would be desirable to attach a product label to the wire or tubular rack in such a manner that when the product is fully depleted, a person restocking the shelves could easily determine what product was there. The person restocking the shelves could then add the same product to the same shelf.

Traditional product labels having a sticky adhesive backing are not particularly useful in and of themselves for this purpose. For example, there is no adequate support for the label between the various tubes and wire construction of the rack. The label tends to fall through the gap between the wires. At the same time, the sticky surface on the back of the label tends to collect debris and the like and may present an unsanitary situation.

Furthermore, removing such labels from the rack may be difficult and time consuming. Pulling the label directly off the rack may result in a portion of the label, or the sticky backing surface, remaining on the wire rack. Thus, it may be necessary to frequently clean the wire rack.

An additional problem that has recently presented itself comes with the advent of computerized inventory using bar codes. Many locations on wire racks and the like that may have previously been used to support product labels are now being used to support bar coded information used in computerized inventory taking. Thus, the ability of the store operator to add an appropriate label to a wire or tubular rack structure may be further limited by the necessity of adding computerized inventory information to the few available locations.

Thus, while it has often been highly desirable to place a removable product label on a tubular-type support rack, no adequate support mechanism has been available. Labels having sticky backs and the like can be simply placed across a pair of wire supports. This mechanism, however, results in a label that will likely be torn and defaced with use. Likewise, it is difficult to remove the label and replace it with a new label in the event the store operator determines that realignment of product stock would be advisable.

Accordingly, it would be an advancement in the art to provide an apparatus for removably mounting product labels onto tubular or wire support shelving. It would also be an advancement in the art to provide an apparatus which adequately supported the labels in order to prevent tearing and defacing of the labels with use. It would be a related advancement in the art to provide an apparatus which allowed for easy replacement of the label. Another advancement in the art would be to provide an apparatus which provided for the attachment of a label to a rack in such a manner as to indicate what product was there once the product was depleted. It would also be an advancement in the art to provide a mechanism for attaching labels to tubular or wire racks without leaving a significant amount of sticky residue on a large portion of the rack once the label is removed.

Such an apparatus is disclosed and claimed herein.

BRIEF SUMMARY AND OBJECTS OF THE INVENTION

The present invention relates to an improved product identification system. In particular, the present invention relates to a structure for supporting product labels which can be attached to wire or tubular racks within a grocery store.

The product identification system of the present invention generally comprises a plastic structure that can be placed by snapping engagement between a pair of parallel tubes or wires which form a rack. The size of the plastic structure may, of course, vary in order to allow it to be used with varying types of shelving materials. In one embodiment of the present invention, the plastic structure comprises a generally planar face. The planar face is of a size which approximates the gap between a pair of parallel wire supports.

Protruding downwardly from the planar face is at least a pair of side walls. In the event that the planar face is rectangular in configuration, the side walls will protrude downwardly on at least two opposing edges of the rectangle. The side walls are configured in such a manner as to be able to snappingly engage the parallel tubular members which form a portion of the rack support.

In one preferred embodiment of the present invention, the downwardly protruding side walls form a generally concave curve beginning at the edge of the rectangular face and ending at the base of the side wall. The concave curve is chosen to be of such configuration as to allow the structure to snappingly engage a pair of tubular members which form a portion of the rack support.

In one embodiment of the present invention the product identification member also includes an additional pair of downwardly protruding side walls. These downwardly protruding side walls are on the two remaining opposing edges of the rectangular face. Thus, the rectangular face and the four downwardly protruding side walls form an inverted trough structure. As mentioned above, in most applications at least two of the downwardly protruding side walls are configured such that they form a concave curve configuration which can then be used to snap the product identification member in place between a pair of parallel tubular members.

Attached to the base of the downwardly protruding side walls may be an additional lip structure. The lip structure extends perpendicularly outwardly from the remainder of the product identification member. The lip structure aids in further securing the structure in place between the pair of tubular members.

A final element of the overall structure is the product label. It will be appreciated that the product label can simply be placed over the top of the rectangular planar face. Thus, the label is provided with a secure support so that it does not become damaged with use. In addition, the label need not overlap the tubular members to a large extent. It will be appreciated, however, that the label may desirably overlap a portion of the tubular members in order to further secure the label and the product identification member in place. The label may extend generally in a parallel plane with the lip structure.

The novel features of this invention, as well as the invention itself, both as to its structure and its operation, will be best understood from the accompanying drawings, taken in conjunction with the accompanying description, in which similar reference characters refer to similar parts, and in which:

DETAILED DESCRIPTION OF THE PREFERRED EMBODIMENT

The present invention relates to a product identification member which is insertable within existing rack structures such as those typically used in grocery stores. The present invention may be used in numerous other settings where it is necessary to label items on a rack. For example, the present invention will be useable in any setting where an inventory is maintained and labeling of the inventory is desirable.

Figure 1:
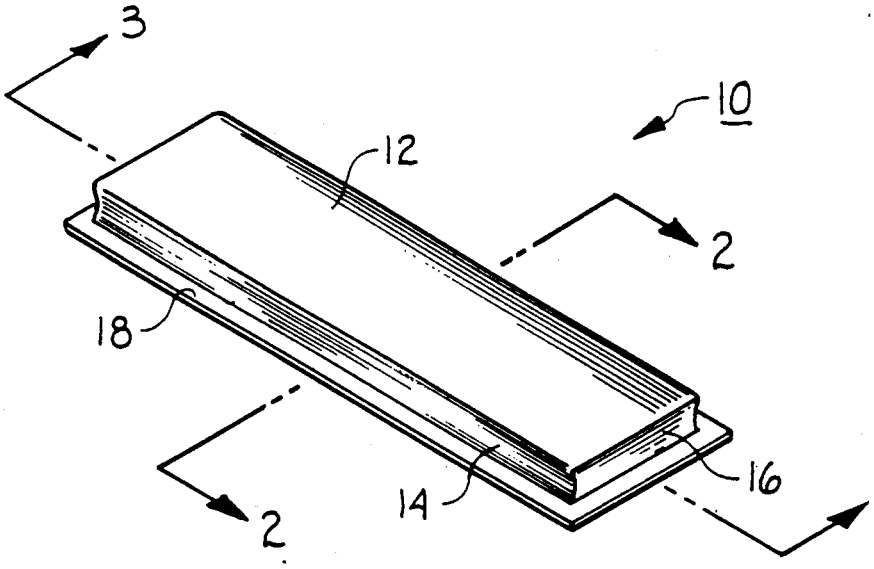
FIG. 1 is a perspective view of the product identification member of the present invention.

The present invention can be best understood with reference to the drawings wherein like parts are designated with like numerals throughout. Referring particularly to FIG. 1, the product identification member of the present invention is illustrated and generally designated 10. The product identification member illustrated in FIG. 1 comprises a generally planar face 12. As mentioned above, the generally planar face 12 is used, in at least one embodiment of the present invention, to support a product label. The planar face 12 may be of any shape and size. The planar face 12 illustrated in FIG. 1, however, is generally rectangular in shape. For many applications, a generally rectangular planar face 12 is preferred because of the fact that many product labels are also generally rectangular. However, other shapes including circles, squares, triangles, and other multisided shapes may also be used. If a round planar face 12 is used it will be possible to insert the product identification member 10 within a round space formed in a tubular rack structure.

FIG. 1 also illustrates the downwardly extending side walls of the present invention. In particular, FIG. 1 illustrates a first downwardly extending side wall 14 which is configured in such a manner as to be able to snappingly engage the tubular members of a rack support. The first engaging side walls 14 are disposed on opposite sides of the rectangle formed by the generally planar face 12. In other configurations of planar face 12, the side walls may be in different positions. It is only necessary that the first engaging side walls 14 be positioned as so to be capable of holding the product identification member in place between one or more tubular members of the rack support system. For example, the rack support may form a triangle or circle. In such event, the engaging side walls will also follow a triangle or circle in order to engage the tubular supports.

In the embodiment of the invention illustrated in FIG. 1, the downwardly extending side walls 14 form a generally concave curve. This concave curve corresponds to the outside curvature of the tubular support members. Thus, the product identification member 10 may be snapped in place between the tubular members with the side walls 14 engaging those members in order to hold the product identification member 10 securely in place.

Also illustrated in FIG. 1 is a second pair of downwardly extending side walls 16. As will be discussed in further detail below, it is not always necessary that side walls 16 also form a concave curve. Side walls 16, as illustrated in the embodiment in FIG. 1, simply provide a method of providing structural integrity to the overall device. However, in certain instances it may be desirable to provide side walls 16 with a concave curve configuration similar to that of side walls 14. Thus, the side walls 16 could be used to snappingly engage the tubular supports of the rack system.

Also illustrated in FIG. 1 is a lip structure 18. Lip structure 18 extends generally perpendicularly outwardly from the lower edges of the side walls 14 and 16. Lip structure 18 is generally in a plane which is parallel to the plane of the planar face 12. The function of lip structure 18 is, at least partially, to provide structural integrity to the overall apparatus. Lip structure 18 also aids in engaging the tubular members once the product identification member 10 is in place. This can be appreciated more fully with reference to FIG. 4 which will be discussed below.

Figure 2:
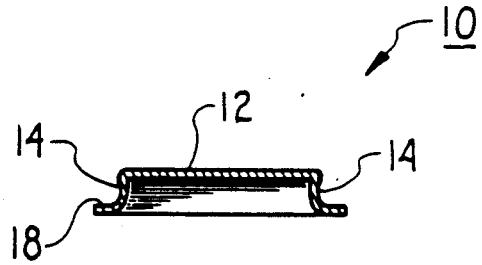
FIG. 2 is a cross-sectional view of the product identification member of the present invention taken along line 2—2 shown in FIG. 1.

Referring now to FIG. 2, a cross-section of the product identification member 10 along lines 2—2 of FIG. 1 is shown. The planar face 12 of the product identification member 10 is illustrated in FIG. 2. Extending downwardly in a concave curve are sidewalls 14. As can be fully appreciated from FIG. 2, the curved configuration of side walls 14 is such that the product identification member 10 can be snapped in place between a pair of tubular members which run in parallel directions.

Also illustrated in FIG. 2 is the lip structure 18. It can be seen from FIG. 2 that lip structure 18 extends generally outwardly in a perpendicular direction from the base of side walls 14. Lip structure 18 lies in a plane which is generally parallel to the plane of the planar face 12.

Figure 3:
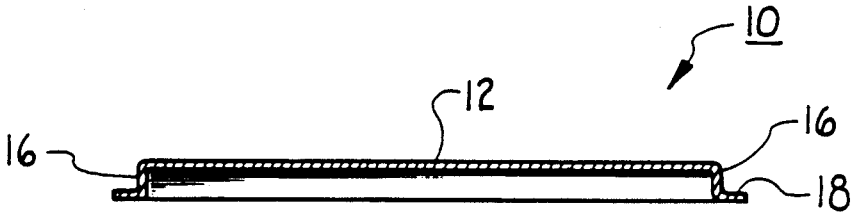
FIG. 3 is a cross-sectional view of the the product identification member of the present invention taken along line 3—3 shown in FIG. 1.

FIG. 3 is a cross-sectional view of the product identification member 10 taken along lines 3—3 in FIG. 1. As with FIG. 2, generally planar face 12 and lip structure 18 are illustrated. FIG. 3, however, provides additional detail concerning the configuration of the second, generally nonengaging side walls 16. In the embodiment of the device shown in FIG. 3, the second nonengaging side walls 16 protrude downwardly at a slight angle from the generally planar face 12. Side walls 16, however, do not necessarily trace a concave curve as do side walls 14. If, however, it is desirable to have side walls 16 engage a tubular member of the rack support, it may be desirable to have side walls 16 trace a curve similar to side walls 14.

Figure 4:
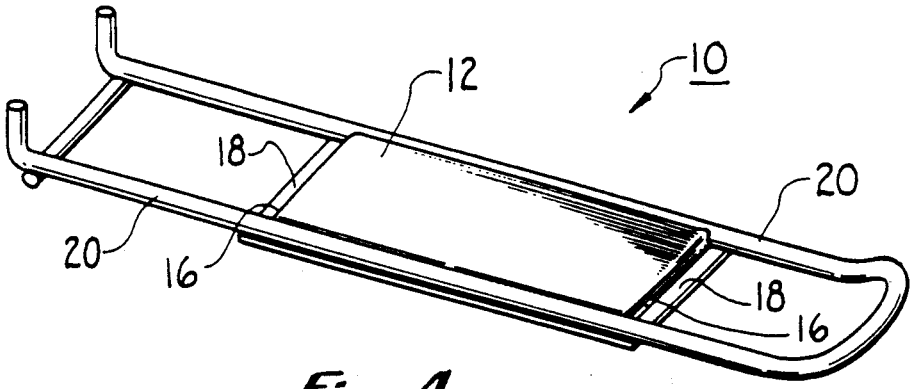
FIG. 4 is a perspective view of the product identification member shown in place between a pair of tubular members which form a portion of a rack.

The method of use of the product identification member 10 can be fully appreciated with reference to FIG. 4. FIG. 4 illustrates the product identification member 10 snapped in place between a pair of tubular members 20 which extend in a generally parallel direction. Tubular members 20 may be in any configuration found within a typical grocery store or in any other rack setting.

As illustrated in FIG. 4, the product identification member 10 securely engages tubular members 20. It can also be appreciated that planar face 12 is of such a size and configuration as to fit securely between the gap formed between parallel extending tubular members 20. The exact length of planar face 12 can be varied depending on various label uses. The size of planar face 12 will be determined by the width of the gap between the tubular members 20 and the length of the particular label used.

Also illustrated in FIG. 4 is lip structure 18. It can be appreciated from FIG. 4 that lip structure 18 not only provides structural integrity to the overall device, but also aids in holding the product identification member 10 securely in place between tubular members 20.

Figure 5:
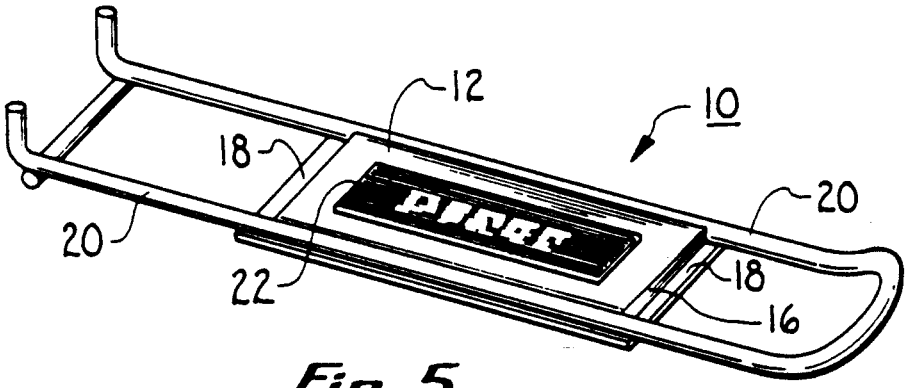
FIG. 5 is a perspective view of the product identification member shown in place between a pair of parallel extending tubular support members and further showing the product label in place on the planar face of the product identification member.

FIG. 5 illustrates the product identification member 10 in place between a pair of tubular members 20 in a similar manner to that illustrated in FIG. 4. In FIG. 5, however, a label is placed across the top of planar face 12. As can be appreciated with reference to FIG. 5, planar face 12 provides a support backing for the label 22. Label 22 is not likely to be pushed between tubular supports 20 during use. Thus, the label is less likely to be defaced or torn.

Figure 7:
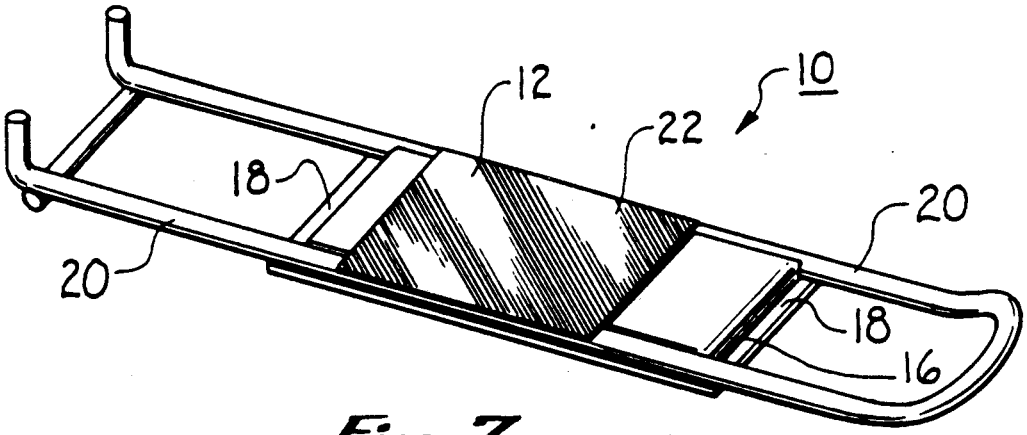
FIG. 7 is a perspective view of the product identification member on parallel tubular supports showing the product label with edges extending beyond the planar face of the product identification member.

Illustrated in FIG. 7 is the manner in which the label may be used in order to help to more securely attach the product identification member 10 to the rack. Specifically, label 22 may be constructed so that it slightly overlaps the generally planar face 12. Thus, the sticky backing material of label 22 may engage, to a small extent, the tubular members 20. Thus, lip 18 and label 22 act together with the first engaging side walls 14 in order to securely, but removably, fasten product identification member 10 in place.

In order to remove the product identification member 10, it is simply necessary to disengage the small portion of the label that overlaps the tubular members 20 and then to snap product identification member 10 from between tubular members 20. Thus, product identification member 10 is securely, but removably, fastened in place. These features provide the store operator with the ability to place various product identification members 10 at various chosen locations within a rack structure. When it is necessary to move the label it is a simple matter to remove the product identification member 10 and place it in a new location or replace it with a new structure. Thus, the present invention provides increased flexibility in supporting labels within a tubular type rack structure.

Figure 6:
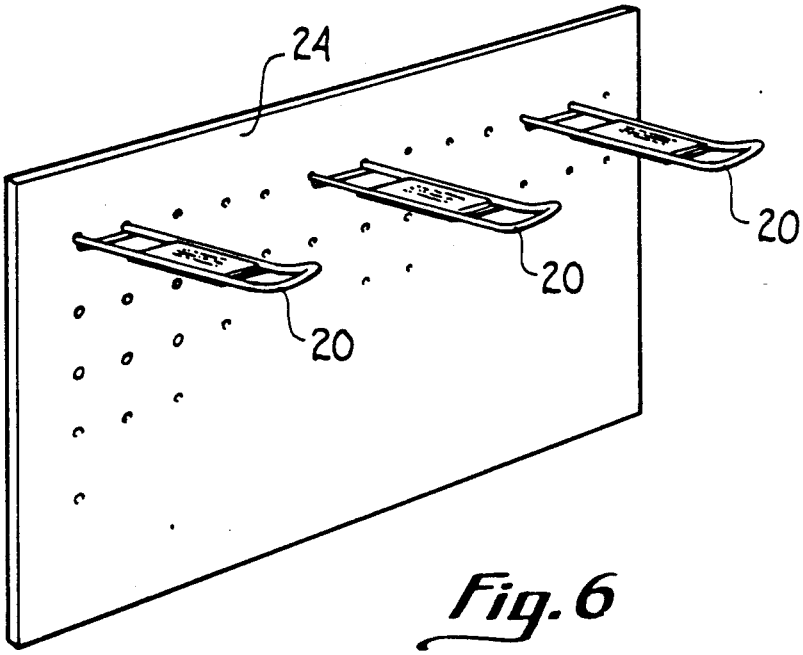
FIG. 6 is a perspective view showing a product rack including a plurality of the product identification members of the present invention.

FIG. 6 is a perspective view showing a plurality of tubular members 20 within a rack system 24. As can be appreciated with reference to FIG. 6, the various tubular members 20 may be moved within rack system 24. At the same time, labels may be interchanged as necessary. Alternatively, product identification member 10 along with label 22 and tubular member 20 can all be moved as a unit and placed at a new location within the rack system 24.

It will be appreciated that product identification member 10 may be constructed of any desirable material. It is presently preferred that plastic material be used. However, other flexible materials, including metals and even semi-rigid cardboard may also be used. In addition, as mentioned above, any configuration of product identification member 10 should also be considered to be within the scope of the present invention. For example, triangular, circular, hexagonal and other shaped devices may be desirable if the various tubular supports form corresponding shapes.

Accordingly, it will be appreciated that each of the objects of the present invention has been met by the invention as described. The present invention provides a means for flexibly mounting labels in store and other types of displays. The mounting of labels in this type of display has been a serious problem in the past. The improved system of the present invention provides for supporting labels such that they will not tear easily or become defaced during use. At the same time, the present invention provides an effective means for removably attaching labels to wire racks. These labels can be easily replaced without leaving a significant amount of sticky residue on the wire rack. In addition, the labels can be used in order to indicate the type of product that was removed from the rack. This aids in restocking store shelves. The removable attachment of the product identification member 10 and product label 22 also provides for increased flexibility in moving the labels and the products within the store as is needed.

It will be appreciated that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A product identification and support system comprising:

a pair of parallel tubular members for supporting said product;

a product identification member having a generally planar face, a first pair of side walls extending generally downwardly from said face, and a second pair of side walls extending generally downwardly from said face, at least one of said pairs of said side walls extending downwardly over a generally concave curve such that the outwardly facing surfaces of said side walls are removably engaged between said tubular members;

a lip structure extending outwardly from the lower edge of each of said side walls generally in a plane parallel to the plane of said planar face; and a label securely but removably attached to said planar face, said label extending beyond the planar face and being further securely but removably attachable to said tubular members, said lip and label acting together with said side walls to securely but removably fasten said product identification member in place on said tubular members.

2. A product identification system as defined in claim 1 wherein said planar face is generally rectangular.

3. A product identification system as defined in claim 1 further comprising two nonengaging side walls extending downwardly from said planar face.

4. A product identification system as defined in claim 1 wherein said product identification member is constructed of a plastic material.

5. A removable label system as defined in claim 1 wherein said tubular members comprise a portion of a product rack.

6. A removable label system as defined in claim 5 wherein said label contains product information.

7. A structure for supporting a product and a product label comprising:

a support;

a pair of tubular members extending substantially horizontally from said support to support a product;

a generally rectangular planar face having four edges;

a first pair of side walls extending generally downwardly over a generally concave curve from two opposing edges of said face for removable engagement between said tubular members;

a second pair of side walls extending generally downwardly form the remaining two opposing edges of said face, said planar face and said first and second pair of side walls forming an inverted trough structure;

a lip structure extending generally perpendicularly outwardly from the lower edge of said side walls and lying generally in a plane parallel to the plane of the planar face; and a product label removably attached to said planar face and also engaging at least a portion of said tubular members, said lip and label acting together with said side walls to securely but removably fasten said planar face in place on said tubular members.

8. A product holder comprising:

a generally rectangular planar face having four edges;

a first pair of side walls extending generally downwardly over a generally concave curve from two opposing edge of said face;

a second pair of side walls extending generally downwardly from the remaining two opposing edges of said face, said planar face, said first pair of side walls, and said second pair of side walls forming an inverted trough structure;

a pair of tubular members positioned such that each tubular member snappingly engages the outwardly facing surface of one of the first pair of sidewalls for removably holding said first pair of sidewalls of said planar face between said tubular members;

a lip structure extending outwardly from the lower edge of said side walls generally in a plane parallel to the plane of said planar face; and a label securely but removably attached to said planar face;

said label extending beyond the planar face and being further securely but removably attachable to said tubular members, said lip and label acting together with said side walls to securely but removably fasten said product identification member in place on said tubular members.

* * * * *